US007830325B2

(12) United States Patent
Qi et al.

(10) Patent No.: US 7,830,325 B2
(45) **Date of Patent: *Nov. 9, 2010**

(54) MOBILE WIRELESS COMMUNICATIONS DEVICE INCLUDING AN ELECTRICALLY CONDUCTIVE DIRECTOR ELEMENT AND RELATED METHODS

(75) Inventors: Yihong Qi, St. Agatha (CA); Adrian Cooke, Kitchener (CA); Ying Tong Man, Waterloo (CA); Perry Jarmuszewski, Waterloo (CA)

(73) Assignee: Research In Motion Limited, Waterloo, Ontario (CA)

( * ) Notice: Subject to any disclaimer, the term of this patent is extended or adjusted under 35 U.S.C. 154(b) by 101 days.

This patent is subject to a terminal disclaimer.

(21) Appl. No.: 12/198,157

(22) Filed: Aug. 26, 2008

(65) Prior Publication Data

US 2008/0316122 A1 Dec. 25, 2008

Related U.S. Application Data

(63) Continuation of application No. 11/331,516, filed on Jan. 13, 2006, now Pat. No. 7,423,605.

(51) Int. Cl.
*H01Q 1/24* (2006.01)

(52) U.S. Cl. ..... 343/818; 343/702

(58) Field of Classification Search ..... 343/818, 343/833–834, 702, 700 MS
See application file for complete search history.

(56) References Cited

U.S. PATENT DOCUMENTS

| | | | | |
|---|---|---|---|---|
| 6,614,399 | B2 | 9/2003 | Trumbull et al. | 343/702 |
| 6,639,564 | B2 | 10/2003 | Johnson | 343/702 |
| 6,876,331 | B2 | 4/2005 | Chiang et al. | 343/702 |
| 6,897,817 | B2 | 5/2005 | Jo et al. | 343/702 |
| 7,126,545 | B2 | 10/2006 | Nagano et al. | 343/702 |
| 7,180,464 | B2 | 2/2007 | Chiang et al. | 343/833 |
| 7,224,321 | B2 | 5/2007 | Chiang et al. | 343/833 |
| 7,239,270 | B2 | 7/2007 | Qi et al. | 342/357.1 |
| 7,595,759 | B2 * | 9/2009 | Schlub et al. | 343/702 |
| 7,619,582 | B2 * | 11/2009 | Chung et al. | 343/876 |
| 7,642,970 | B2 * | 1/2010 | Aoyama et al. | 343/702 |
| 2006/0267834 | A1 * | 11/2006 | Qi et al. | 342/357.1 |
| 2009/0121947 | A1 * | 5/2009 | Nysen | 343/702 |

FOREIGN PATENT DOCUMENTS

| | | |
|---|---|---|
| DE | 20114640 U | 5/2001 |
| DE | 10248756 | 3/2004 |
| EP | 1271688 | 1/2003 |
| EP | 1353401 | 10/2003 |
| WO | WO2005/004277 | 1/2005 |

* cited by examiner

*Primary Examiner*—Huedung Mancuso
(74) *Attorney, Agent, or Firm*—Allen, Dyer, Doppelt, Milbrath & Gilchrist, P.A.

(57) ABSTRACT

A mobile wireless communications device may include a portable housing, a printed circuit board (PCB) carried by the portable housing, a wireless transceiver carried by the PCB, and an antenna connected to the transceiver and carried by the PCB. The mobile wireless communications device may further include at least one director element for directing a beam pattern of the antenna. More particularly, the at least one director element may include an electrically conductive main branch carried by the portable housing, and an electrically conductive connector portion extending between the main branch and the PCB.

25 Claims, 7 Drawing Sheets

MOBILE WIRELESS COMMUNICATIONS DEVICE INCLUDING AN ELECTRICALLY CONDUCTIVE DIRECTOR ELEMENT AND RELATED METHODS

RELATED APPLICATION

This application is a continuation of Ser. No. 11/331,516 filed Jan. 13, 2006, now U.S. Pat. No. 7,423,605, issued Sep. 9, 2008, the disclosure of which is hereby incorporated by reference in its entirety.

FIELD OF THE INVENTION

The present invention relates to the field of communications devices, and, more particularly, to mobile wireless communications devices and related methods.

BACKGROUND OF THE INVENTION

Cellular communications systems continue to grow in popularity and have become an integral part of both personal and business communications. Cellular telephones allow users to place and receive voice calls most anywhere they travel. Moreover, as cellular telephone technology has increased, so too has the functionality of cellular devices and the different types of devices available to users. For example, many cellular devices now incorporate personal digital assistant (PDA) features such as calendars, address books, task lists, etc. Moreover, such multi-function devices may also allow users to wirelessly send and receive electronic mail (email) messages and access the Internet via a cellular network and/or a wireless local area network (WLAN), for example.

Even so, as the functionality of cellular communications devices continues to increase, so too does the demand for smaller devices which are easier and more convenient for users to carry. One challenge this poses for cellular device manufacturers is designing antennas that provide desired operating characteristics within the relatively limited amount of space available for the antenna.

One exemplary cellular antenna structure is disclosed in U.S. Pat. No. 6,897,817 to Jo et al. The antenna includes a conductive top plate formed in the shape of a spiral. In one embodiment a sidewall meanderline extends from an edge of the top plate in the direction of a ground plane. A shorting meanderline connects the top plate and the ground plane. A first region of the top plate overlies the ground plane. A second region of the top plate extends beyond the ground plane. Tuning is provided by adjusting the length and other dimensions of the meanderlines.

For internal antennas such as the one described above which are carried within the housing of a cellular device, it is typically difficult for such devices to comply with applicable specific absorption rate (SAR) and hearing aid compatibility (HAC) requirements due in part to the relatively close proximity of the antenna to the user's ear. As such, further improvements may be desirable to help achieve desired SAR and/or HAC requirements.

DETAILED DESCRIPTION OF THE PREFERRED EMBODIMENTS

Figure 1:
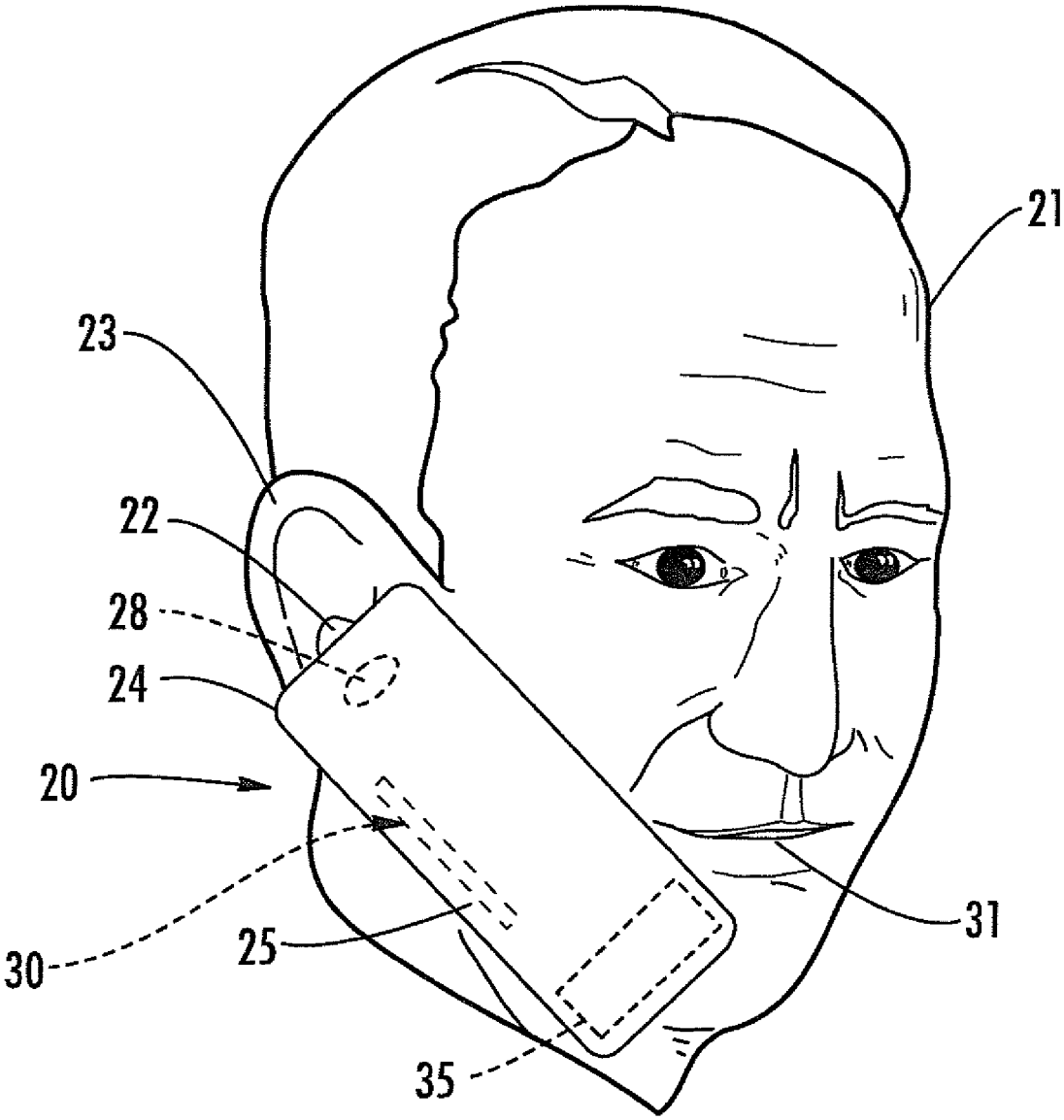
FIG. 1 is a perspective view of a mobile wireless communications device in accordance with the invention next to a user wearing an electronic hearing aid.

The present description is made with reference to the accompanying drawings, in which preferred embodiments are shown. However, many different embodiments may be used, and thus the description should not be construed as limited to the embodiments set forth herein. Rather, these embodiments are provided so that this disclosure will be thorough and complete. Like numbers refer to like elements throughout, and prime and multiple prime notation are used to indicate similar elements in alternative embodiments.

Generally speaking, a mobile wireless communications device is disclosed herein which may include a portable housing, a printed circuit board (PCB) carried by the portable housing, a wireless transceiver carried by the PCB, and an antenna connected to the transceiver and carried by the PCB. The mobile wireless communications device may further include at least one director element for directing a beam pattern of the antenna. More particularly, the at least one director element may include an electrically conductive main branch carried by the portable housing, and an electrically conductive connector portion extending between the main branch and the PCB. The director element(s) may advantageously be used to direct the beam pattern of the antenna to reduce interference with a hearing aid of a user, for example, to advantageously improve hearing aid compatibility of the mobile wireless communications device, for example.

The PCB may include a top portion and a bottom portion, and the antenna may be carried by the bottom portion of the PCB. Moreover, the PCB may have a generally rectangular shape with opposing sides and opposing ends, and the electrically conductive main branch may extend parallel with a side of the PCB. The at least one director element may also be a pair thereof, with a respective electrically conductive main branch of each director element extending parallel to a respective side of the PCB. Furthermore, the electrically conductive main branch may extend parallel with the rear surface of the PCB.

The electrically conductive main branch may be carried within the portable housing or externally of the portable housing. In addition, the PCB may include an antenna feed area connected to the antenna, and the electrically conductive connector portion may contact the PCB adjacent the antenna feed area. Also, the antenna may have an operating wavelength, and the electrically conductive main branch may have a length of about ¼ to ½ of the operating wavelength, for example. The electrically conductive main branch may be an electrically conductive bar, for example. Moreover, the electrically conductive connector portion may extend transversely from a medial portion of the electrically conductive main branch. Additionally, the wireless transceiver may be a cellular transceiver, for example.

A method aspect is for improving hearing aid compatibility (HAC) of a mobile wireless communications device, such as the one discussed briefly above, for a user with an electronic hearing aid. The method may include positioning at least one director element for directing a beam pattern of the antenna to reduce interference with the hearing aid. The at least one director element may include an electrically conductive main branch carried by the portable housing, and an electrically conductive connector portion extending between the main branch and the PCB.

Referring initially to FIGS. 1 through 4, a mobile wireless communications device, such as a cellular telephone 20, is for a user 21 wearing an electronic hearing aid 22 in an ear 23 of the user. The cellular telephone 20 illustratively includes a portable housing 24 and an audio output transducer 28 (e.g., a speaker) carried by the housing and accessible to the electronic hearing aid 22 of the user 21 adjacent the top of the housing as shown. An audio input transducer (i.e., microphone) is also carried by the housing 24 and accessible to a mouth 31 of the user 21 adjacent the bottom of the housing. Although described herein with reference to a cellular device, it should be noted that the present disclosure may be applicable to other wireless communications devices such as wireless LAN devices, etc.

Furthermore, an antenna 35 is illustratively positioned adjacent the bottom of the housing 24 so that the electronic hearing aid 22 of the user 21 is advantageously separated from the antenna when the cellular telephone 20 is held adjacent the user's ear 23. Because of the increased separation thus achieved between the antenna 35 and the electronic hearing aid 22, the cellular telephone 20 advantageously reduces undesired coupling from the antenna to the electronic hearing aid without the need for special shielding arrangements. As a result, this configuration is beneficial from a hearing aid compatibility (HAC) standpoint. Moreover, this also helps reduce SAR, as will be appreciated by those skilled in the art.

The cellular telephone 20 further illustratively includes a printed circuit board (PCB) 37 carried by the housing 24, and the antenna 35 and a wireless (e.g., cellular) transceiver 38 are carried by the PCB. Of course, these components may be carried on the back surface or in positions other than those shown in other embodiments.

The PCB 37 illustratively includes an antenna feed area 40 where the antenna 35 connects to the wireless transceiver 38. The antenna 35 may include a plurality of conductive traces on the PCB 37, for example, as will be appreciated by those skilled in the art. As noted above, the positioning of the antenna 35 adjacent a bottom of the housing 24 advantageously reduces coupling to the electronic hearing aid 22 of the user 21, however the antenna may be located elsewhere in different embodiments. The cellular telephone 20 may further include other components connected to the PCB 37 such as a display, battery, keypad, processing circuitry, etc., as will be discussed further below.

The cellular telephone 20 further illustratively includes one or more director elements 30 for directing a beam pattern of the antenna 35. More particularly, the director element 30 illustratively includes an electrically conductive main branch 32 carried by the housing 24, and an electrically conductive connector portion 33 extending between the main branch and the PCB 37. The director element 30 is advantageously used to direct the beam pattern of the antenna 35 to further reduce interference with the electronic hearing aid 22 of the user 21, for example, to advantageously improve hearing aid compatibility of the cellular telephone 20. That is, by directing the beam pattern of the antenna 35 such that the main lobe gain is directed away from the ear 23, and thus the electronic hearing aid 22, of the user 21, this advantageously reduces the interference with the electronic hearing aid, as will be appreciated by those skilled in the art.

Figure 2:
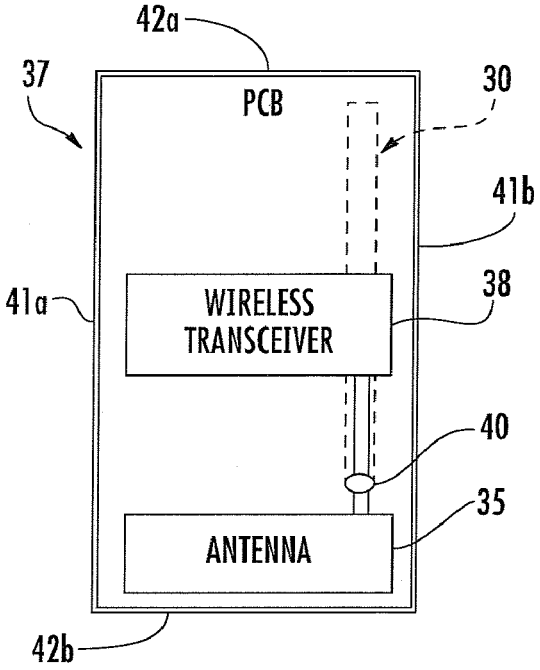
FIG. 2 is a schematic front view of the PCB and director element of the mobile wireless communications device of FIG. 1.
Figure 3:
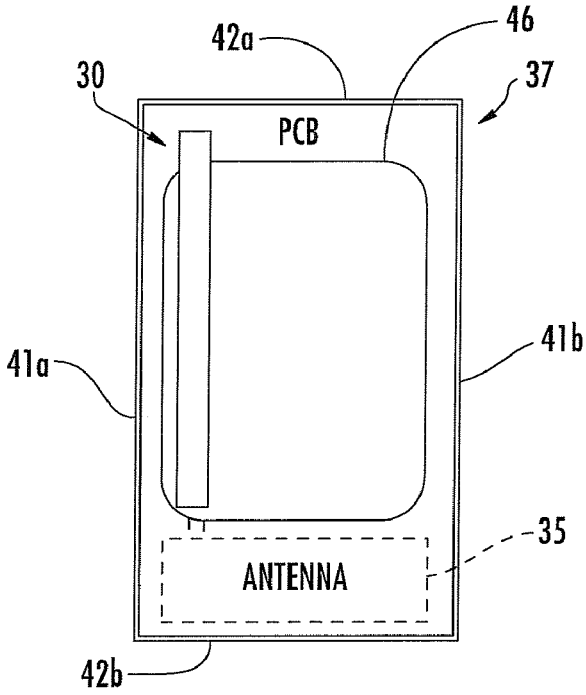
FIG. 3 is a schematic rear view of the PCB and director element of the mobile wireless communications device of FIG. 1.

As seen in FIGS. 2 and 3, the PCB 37 illustratively has a generally rectangular shape with opposing sides 41*a*, 41*b* and opposing ends 42*a*, 42*b*, and the electrically conductive main branch 32 extends parallel with a rear surface of the PCB. The electrically conductive connector portion 33 extends transversely from a medial portion 45 of the electrically conductive main branch 32 and connects the main branch to a ground plane 46 on the back surface of the PCB 37. While the electrically conductive connector portion 33 is shown as a relatively short and straight connector bar in the illustrated example, the connector portion may take various shapes, such as a sawtooth shape, etc. Moreover, the electrically conductive connector portion 33 may be a mechanical connector such as a spring connector, etc.

The electrically conductive main branch 32 is an electrically conductive bar in the illustrated example, although other shapes may be used in different embodiments. By way of example, the electrically conductive main branch 32 may include curved or sawtooth meanders, loops, or other features used to affect the electrical length of the main branch, as will be appreciated by those skilled in the art. The electrically conductive main branch 32 may have a width of about 5 to 7 mm, for example, although other widths may also be used depending upon the given implementation.

The length of the electrically conductive main branch 32 is preferably about ¼ to ½ of the operating wavelength of the antenna 35, for example, to provide desired beam steering for SAR reduction and HAC improvement, but here again other lengths may also be used. Moreover, positioning the electrically conductive connector portion 33 to contact the PCB 37 adjacent the antenna feed area 40 may also assist in this regard by providing greater influence over the direction of beam pattern of the antenna 35.

Figure 7:
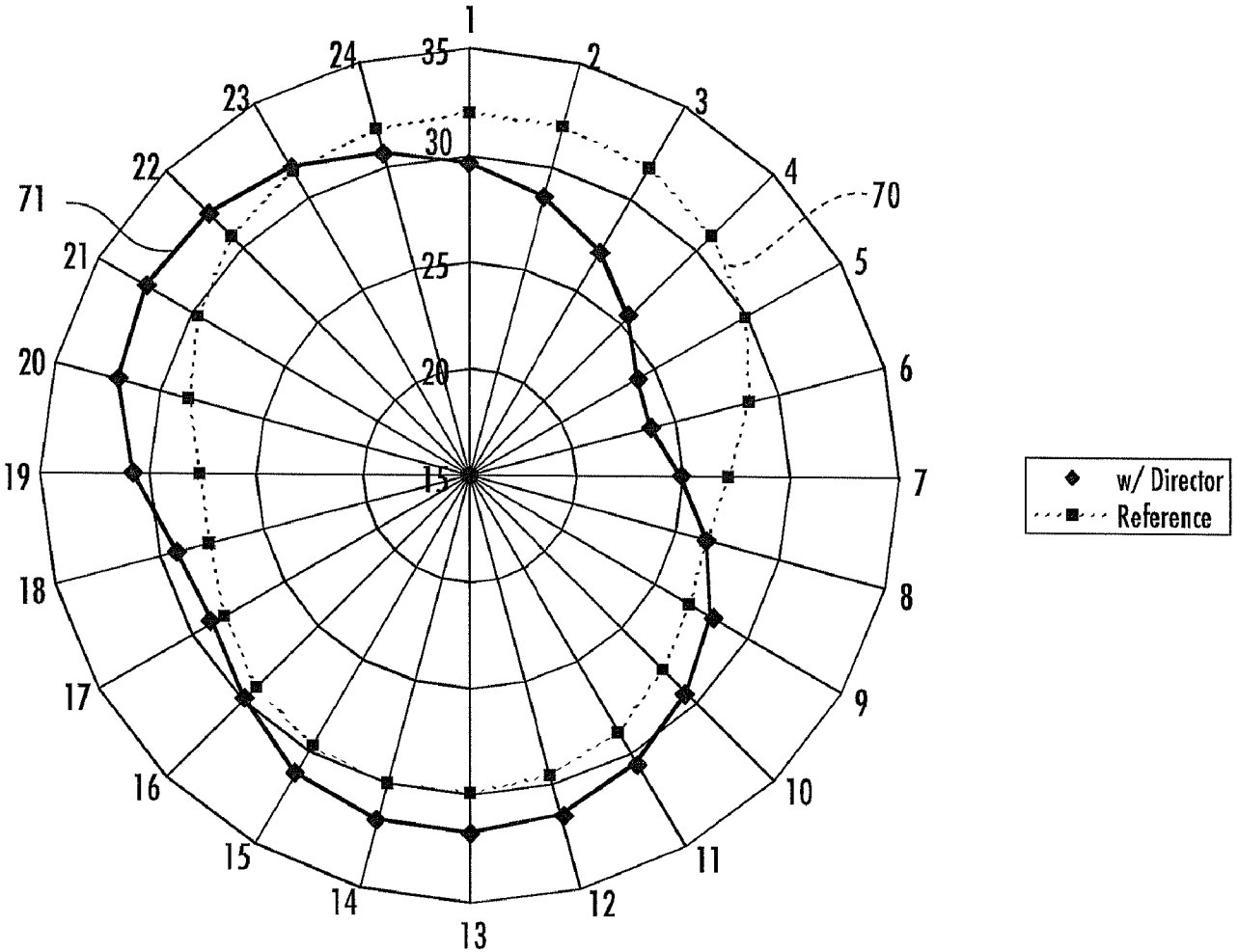
FIGS. 7 through 9 are two-dimensional beam pattern diagrams for a mobile wireless communications device antenna at three respective operating frequencies without an associated director element and with an associated director element in accordance with the invention.
Figure 8:
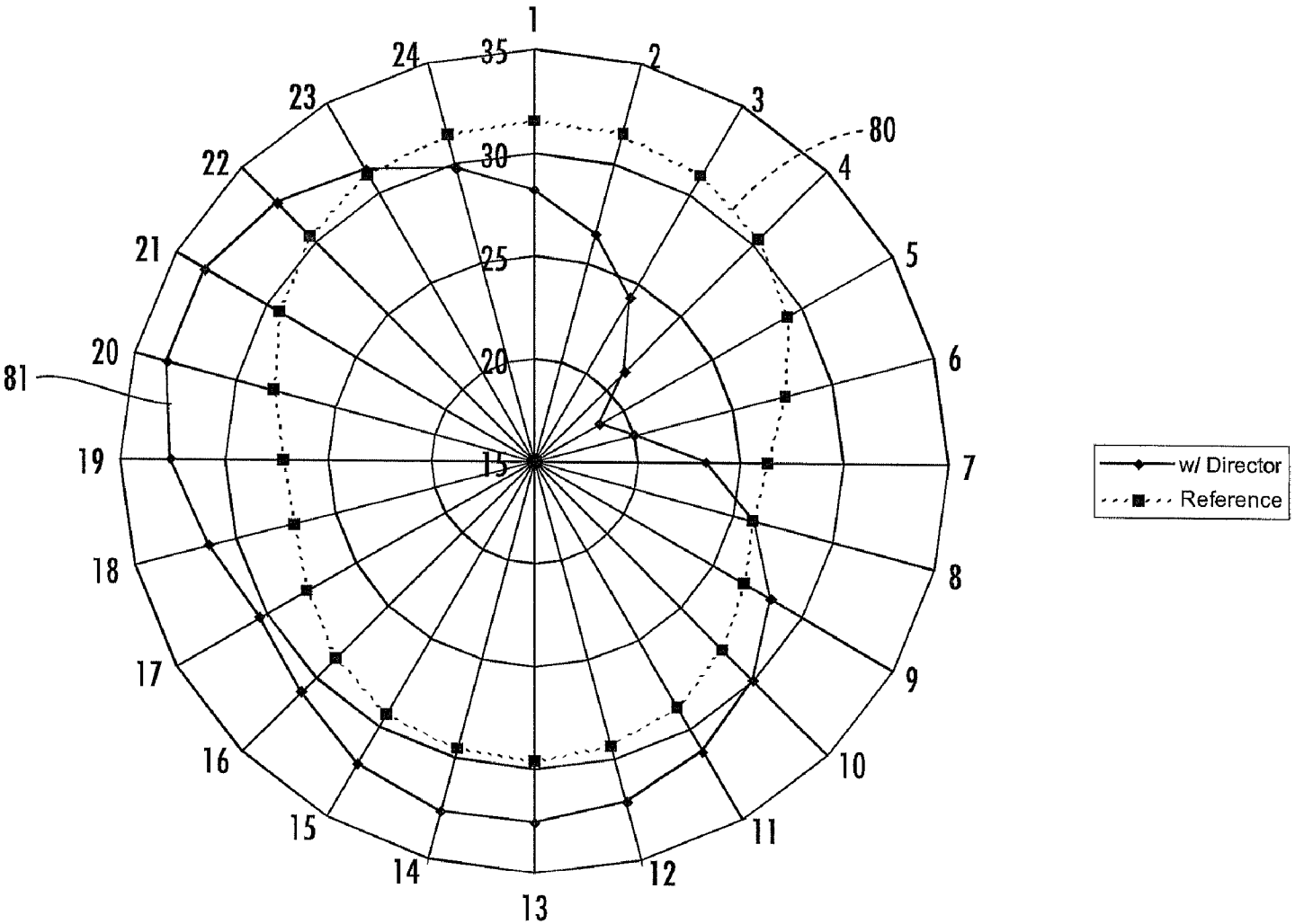
Figure 9:
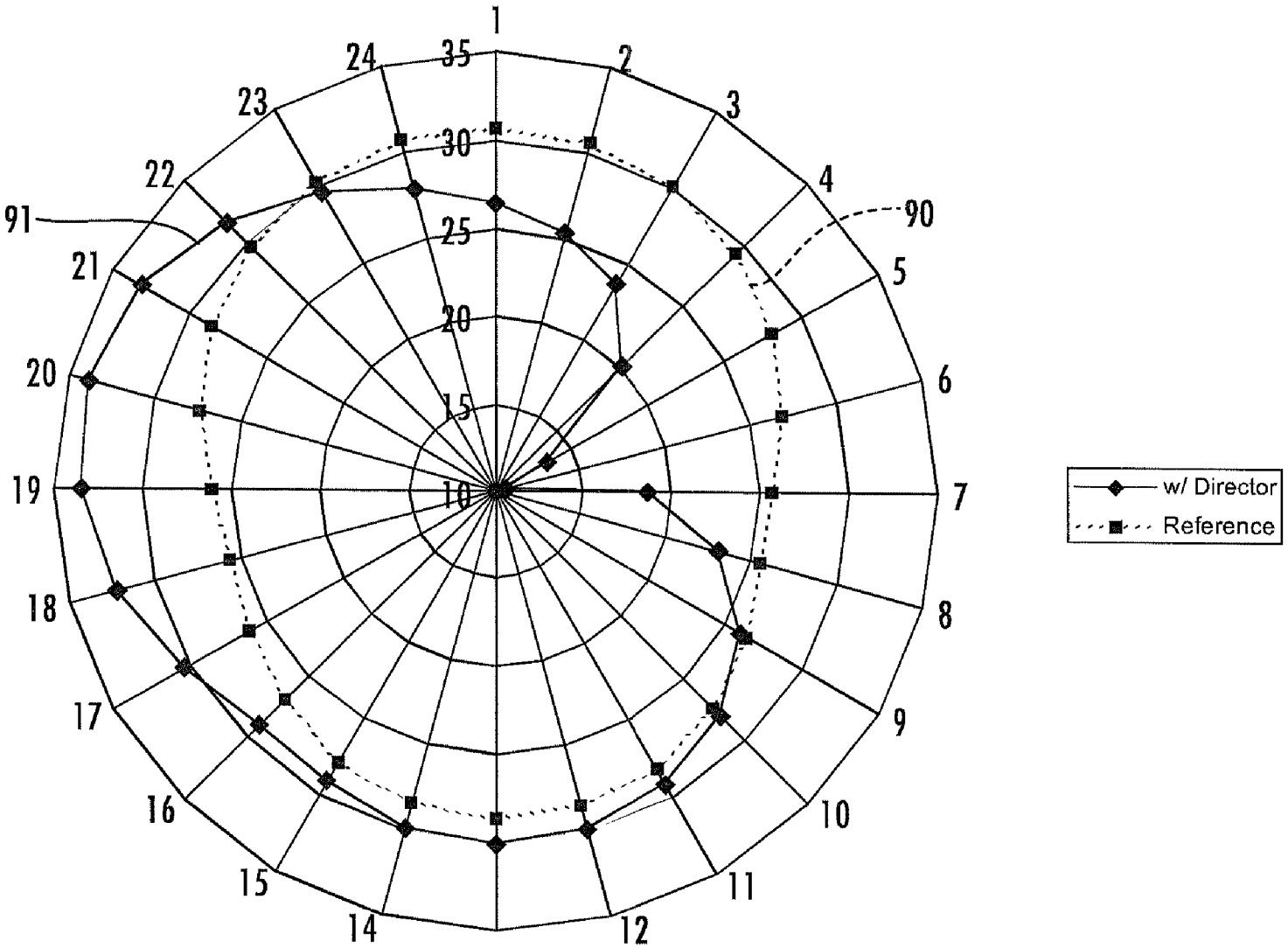

By way of comparison, FIGS. 7 through 9 each illustrate a measured two-dimensional beam pattern 70, 80, 90 for the antenna 35 without an associated director element 30, as well as beam patterns 71, 81, 91 for the antenna with two associated director elements 30, respectively. More particularly, the two director elements 30 were positioned on the back side of the PCB 37 (i.e., similar to the embodiment illustrated in FIGS. 1-4 but with two spaced apart director elements instead of a single director element). The beam patterns 70, 71 correspond to an operating frequency of 1850 MHz, the beam patterns 80, 81 correspond to an operating frequency of 1880 MHz, and the beam patterns 90, 91 correspond to an operating frequency of 1910 MHz.

Figure 4:
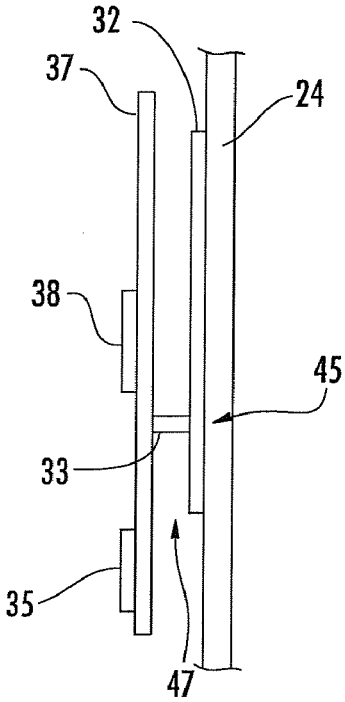
FIG. 4 is schematic side view of the PCB, director element, and housing of the mobile wireless communications device of FIG. 1.

In the present example, the electrically conductive main branch 32 is carried within the housing 24 on an inside sidewall thereof, as seen in FIG. 4. As such, in this embodiment rather than a bar the electrically conductive main branch 32 could be implemented by metallizing the sidewall of the housing 24, for example. Moreover, an air gap 47 is shown between the PCB 37 and the electrically conductive main branch 32, but in some embodiments this space may be filled with a solid dielectric, for example. The electrically conductive main branch 32 may also be partially or completely enclosed within the sidewall of the housing 24.

Figure 5:
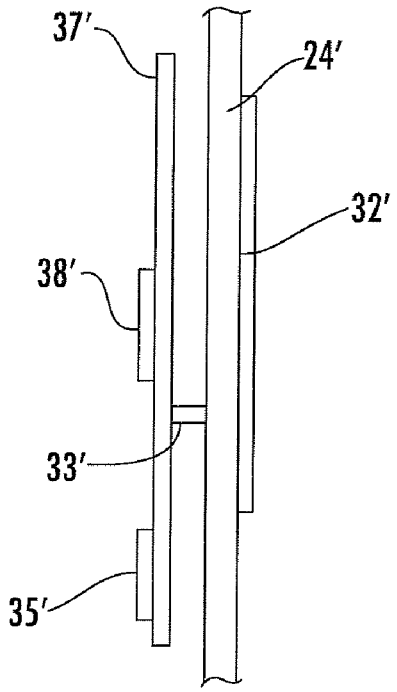
FIG. 5 is a schematic side view of an alternative embodiment of the PCB, director element, and housing of the mobile wireless communications device of FIG. 1.
Figure 6:
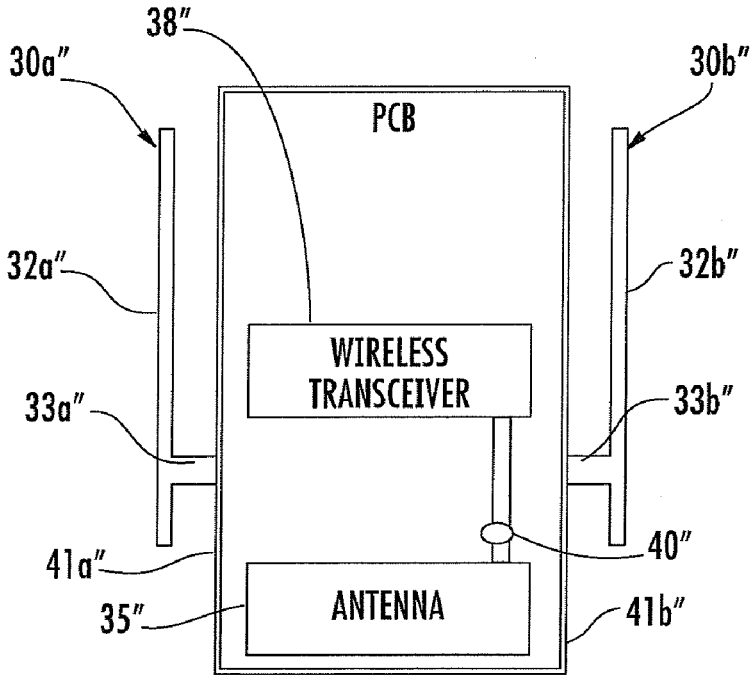
FIG. 6 is a schematic front view of an alternative embodiment of the PCB and director elements of the mobile wireless communications device of FIG. 1.

Turning now additionally to FIG. 5, in an alternative embodiment the electrically conductive main branch 32' may be carried externally of the portable housing 24', i.e., on an outside surface thereof, as shown. In another alternative embodiment, a pair of director elements 30*a*', 30*b*' are included with respective electrically conductive main branches 32*a*', 32*b*' extending parallel to a respective side 41*a*', 41*b*' of the PCB 37 (FIG. 6).

A method aspect is for improving hearing aid compatibility (HAC) of a mobile wireless communications device 20 for a user with an electronic hearing aid 22. The method may include positioning at least one director element 30 for directing a beam pattern of the antenna 35 to reduce interference with the electronic hearing aid 22. As noted above, the at least one director element 30 may include an electrically conductive main branch 32 carried by the portable housing 24, and an electrically conductive connector portion 33 extending between the main branch and the PCB 37.

Other exemplary components of a hand-held mobile wireless communications device 1000 are now described in the example below with reference to FIG. 10. The device 1000 illustratively includes a housing 1200, a keypad 1400 and an output device 1600. The output device shown is a display 1600, which is preferably a full graphic LCD. Other types of output devices may alternatively be utilized. A processing device 1800 is contained within the housing 1200 and is coupled between the keypad 1400 and the display 1600. The processing device 1800 controls the operation of the display 1600, as well as the overall operation of the mobile device 1000, in response to actuation of keys on the keypad 1400 by the user.

The housing 1200 may be elongated vertically, or may take on other sizes and shapes (including clamshell housing structures). The keypad may include a mode selection key, or other hardware or software for switching between text entry and telephony entry.

Figure 10:
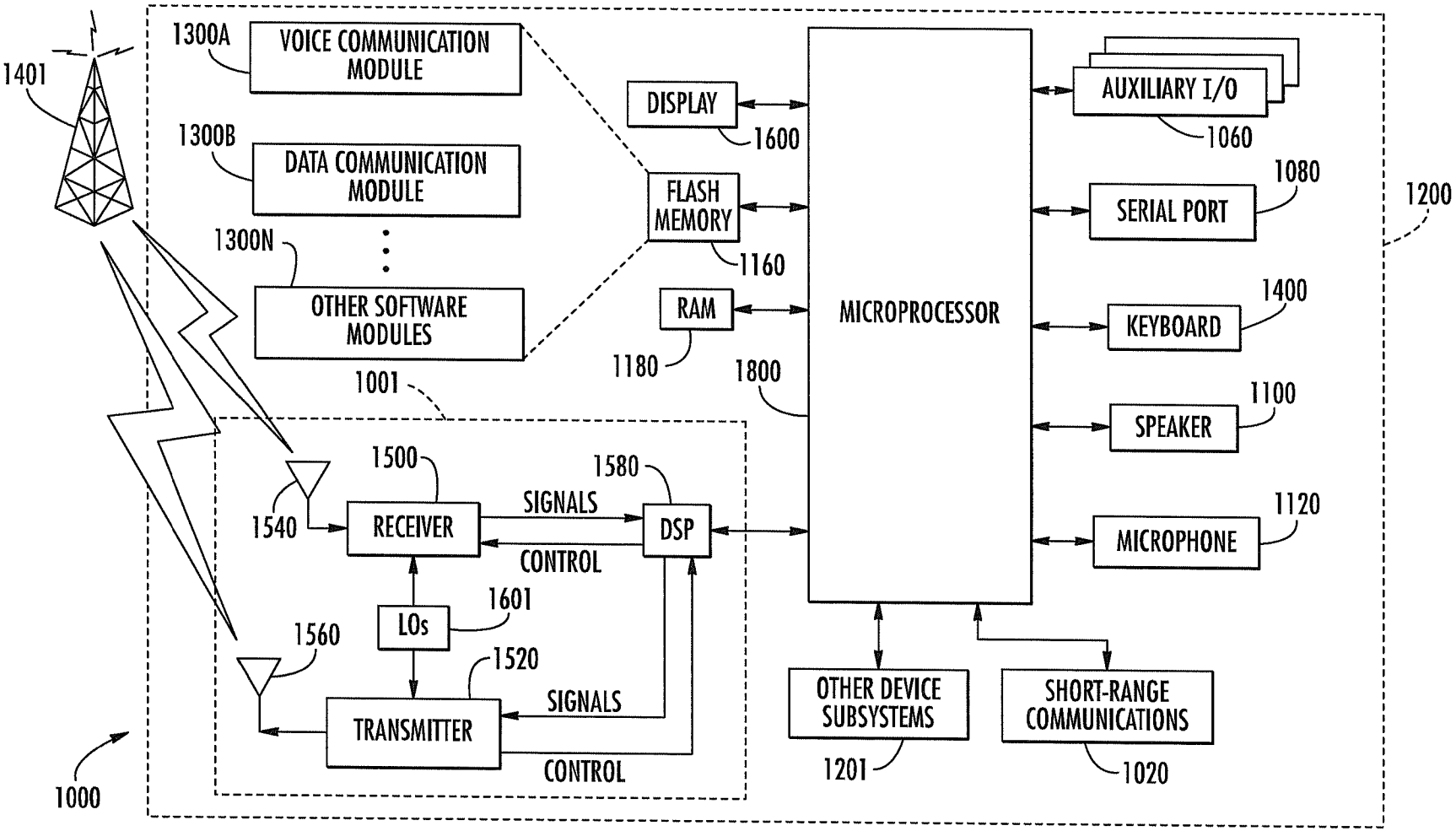
FIG. 10 is a schematic block diagram of the mobile wireless communications device of FIG. 1 illustrating additional exemplary components thereof.

In addition to the processing device 1800, other parts of the mobile device 1000 are shown schematically in FIG. 10. These include a communications subsystem 1001; a short-range communications subsystem 1020; the keypad 1400 and the display 1600, along with other input/output devices 1060, 1080, 1100 and 1120; as well as memory devices 1160, 1180 and various other device subsystems 1201. The mobile device 1000 is preferably a two-way RF communications device having voice and data communications capabilities. In addition, the mobile device 1000 preferably has the capability to communicate with other computer systems via the Internet.

Operating system software executed by the processing device 1800 is preferably stored in a persistent store, such as the flash memory 1160, but may be stored in other types of memory devices, such as a read only memory (ROM) or similar storage element. In addition, system software, specific device applications, or parts thereof, may be temporarily loaded into a volatile store, such as the random access memory (PAM) 1180. Communications signals received by the mobile device may also be stored in the RAM 1180.

The processing device 1800, in addition to its operating system functions, enables execution of software applications 1300A-1300N on the device 1000. A predetermined set of applications that control basic device operations, such as data and voice communications 1300A and 1300B, may be installed on the device 1000 during manufacture. In addition, a personal information manager (PIM) application may be installed during manufacture. The PIM is preferably capable of organizing and managing data items, such as e-mail, calendar events, voice mails, appointments, and task items. The PIM application is also preferably capable of sending and receiving data items via a wireless network 1401. Preferably, the PIM data items are seamlessly integrated, synchronized and updated via the wireless network 1401 with the device user's corresponding data items stored or associated with a host computer system.

Communication functions, including data and voice communications, are performed through the communications subsystem 1001, and possibly through the short-range communications subsystem. The communications subsystem 1001 includes a receiver 1500, a transmitter 1520, and one or more antennas 1540 and 1560. In addition, the communications subsystem 1001 also includes a processing module, such as a digital signal processor (DSP) 1580, and local oscillators (LOs) 1601. The specific design and implementation of the communications subsystem 1001 is dependent upon the communications network in which the mobile device 1000 is intended to operate. For example, a mobile device 1000 may include a communications subsystem 1001 designed to operate with the Mobitex™, Data TAC™ or General Packet Radio Service (GPRS) mobile data communications networks, and also designed to operate with any of a variety of voice communications networks, such as AMPS, TDMA, CDMA, PCS, GSM, etc. Other types of data and voice networks, both separate and integrated, may also be utilized with the mobile device 1000.

Network access requirements vary depending upon the type of communication system. For example, in the Mobitex and DataTAC networks, mobile devices are registered on the network using a unique personal identification number or PIN associated with each device. In GPRS networks, however, network access is associated with a subscriber or user of a device. A GPRS device therefore requires a subscriber identity module, commonly referred to as a SIM card, in order to operate on a GPRS network.

When required network registration or activation procedures have been completed, the mobile device 1000 may send and receive communications signals over the communication network 1401. Signals received from the communications network 1401 by the antenna 1540 are routed to the receiver 1500, which provides for signal amplification, frequency down conversion, filtering, channel selection, etc., and may also provide analog to digital conversion. Analog-to-digital conversion of the received signal allows the DSP 1580 to perform more complex communications functions, such as demodulation and decoding. In a similar manner, signals to be transmitted to the network 1401 are processed (e.g. modulated and encoded) by the DSP 1580 and are then provided to the transmitter 1520 for digital to analog conversion, frequency up conversion, filtering, amplification and transmission to the communication network 1401 (or networks) via the antenna 1560.

In addition to processing communications signals, the DSP 1580 provides for control of the receiver 1500 and the transmitter 1520. For example, gains applied to communications signals in the receiver 1500 and transmitter 1520 may be adaptively controlled through automatic gain control algorithms implemented in the DSP 1580.

In a data communications mode, a received signal, such as a text message or web page download, is processed by the communications subsystem 1001 and is input to the processing device 1800. The received signal is then further processed by the processing device 1800 for an output to the display 1600, or alternatively to some other auxiliary I/O device 1060. A device user may also compose data items, such as e-mail messages, using the keypad 1400 and/or some other auxiliary I/O device 1060, such as a touchpad, a rocker switch, a thumb-wheel, or some other type of input device. The composed data items may then be transmitted over the communications network 1401 via the communications subsystem 1001.

In a voice communications mode, overall operation of the device is substantially similar to the data communications mode, except that received signals are output to a speaker 1100, and signals for transmission are generated by a microphone 1120. Alternative voice or audio I/O subsystems, such as a voice message recording subsystem, may also be implemented on the device 1000. In addition, the display 1600 may also be utilized in voice communications mode, for example to display the identity of a calling party, the duration of a voice call, or other voice call related information.

The short-range communications subsystem enables communication between the mobile device 1000 and other proximate systems or devices, which need not necessarily be similar devices. For example, the short-range communications subsystem may include an infrared device and associated circuits and components, or a Bluetooth™ communications module to provide for communication with similarly-enabled systems and devices.

Many modifications and other embodiments will come to the mind of one skilled in the art having the benefit of the teachings presented in the foregoing descriptions and the associated drawings. Therefore, it is understood that various modifications and embodiments are intended to be included within the scope of the appended claims.

That which is claimed is:

1. A mobile wireless communications device comprising:
- a portable housing;
- a printed circuit board (PCB) carried by said portable housing;
- a wireless transceiver carried by said PCB;
- an antenna connected to said transceiver and carried by said PCB; and
- at least one director element for directing a beam pattern of said antenna and comprising
  - an electrically conductive main branch carried by said portable housing, and
  - an electrically conductive connector portion extending transversely from a medial portion of said electrically conductive main branch to said PCB.

2. The mobile wireless communications device of claim 1 wherein said PCB has a generally rectangular shape with opposing sides and opposing ends; and wherein said electrically conductive main branch extends parallel with a side of said PCB.

3. The mobile wireless communications device of claim 1 wherein said PCB comprises a top portion and a bottom portion; and wherein said antenna is carried by the bottom portion of said PCB.

4. The mobile wireless communications device of claim 1 wherein said PCB has a generally rectangular shape with opposing sides and opposing ends; wherein said at least one director element comprises a pair thereof; and wherein a respective electrically conductive main branch of each director elements extends parallel to a respective side of said PCB.

5. The mobile wireless communications device of claim 1 wherein said PCB has a generally rectangular shape with opposing front and rear surfaces; and wherein said electrically conductive main branch extends parallel with the rear surface of said PCB.

6. The mobile wireless communications device of claim 1 wherein said PCB comprises an antenna feed area connected to said antenna; and wherein said electrically conductive connector portion contacts said PCB adjacent said antenna feed area.

7. The mobile wireless communications device of claim 1 wherein said antenna has an operating wavelength; and wherein said electrically conductive main branch has a length of about ¼ to ½ the operating wavelength.

8. The mobile wireless communications device of claim 1 wherein said electrically conductive main branch comprises an electrically conductive bar.

9. The mobile wireless communications device of claim 1 further comprising a ground plane carried by said PCB; and wherein said electrically conductive connector portion extends between said electrically conductive main branch and said ground plane.

10. A mobile wireless communications device comprising:
- a portable housing;
- a printed circuit board (PCB) carried by said portable housing;
- a ground plane carried by said PCB;
- a wireless transceiver carried by said PCB;
- an antenna connected to said transceiver and carried by said PCB; and
- at least one director element for directing a beam pattern of said antenna and comprising
  - an electrically conductive main branch carried by said portable housing, and
  - an electrically conductive connector portion extending between said electrically conductive main branch and said ground plane.

11. The mobile wireless communications device of claim 10 wherein said PCB has a generally rectangular shape with opposing sides and opposing ends; and wherein said electrically conductive main branch extends parallel with a side of said PCB.

12. The mobile wireless communications device of claim 10 wherein said PCB comprises a top portion and a bottom portion; and wherein said antenna is carried by the bottom portion of said PCB.

13. The mobile wireless communications device of claim 10 wherein said PCB has a generally rectangular shape with opposing sides and opposing ends; wherein said at least one director element comprises a pair thereof; and wherein a respective electrically conductive main branch of each director elements extends parallel to a respective side of said PCB.

14. The mobile wireless communications device of claim 10 wherein said PCB has a generally rectangular shape with opposing front and rear surfaces; and wherein said electrically conductive main branch extends parallel with the rear surface of said PCB.

15. The mobile wireless communications device of claim 10 wherein said PCB comprises an antenna feed area connected to said antenna; and wherein said electrically conductive connector portion contacts said PCB adjacent said antenna feed area.

16. The mobile wireless communications device of claim 10 wherein said antenna has an operating wavelength; and wherein said electrically conductive main branch has a length of about ¼ to ½ the operating wavelength.

17. The mobile wireless communications device of claim 10 wherein said electrically conductive main branch comprises an electrically conductive bar.

18. A method for improving hearing aid compatibility (HAC) of a mobile wireless communications device for a user with an electronic hearing aid and comprising a portable housing, a printed circuit board (PCB) carried by the portable housing, a wireless transceiver carried by the PCB, an antenna connected to the transceiver and carried by the PCB, the method comprising:

positioning at least one director element for directing a beam pattern of the antenna to reduce interference with the electronic hearing aid, the at least one director element comprising an electrically conductive main branch carried by the portable housing and an electrically conductive connector portion extending transversely from the electrically conductive main branch to the PCB.

19. The method of claim 18 wherein the PCB has a generally rectangular shape with opposing sides and opposing ends; and wherein the electrically conductive main branch extends parallel with a side of the PCB.

20. The method of claim 18 wherein the PCB comprises a top portion and a bottom portion; and wherein the antenna is carried by the bottom portion of the PCB.

21. The method of claim 18 wherein the antenna has an operating wavelength; and wherein the electrically conductive main branch has a length of about ¼ to ½ the operating wavelength.

22. A method for improving hearing aid compatibility (HAC) of a mobile wireless communications device for a user with an electronic hearing aid and comprising a portable housing, a printed circuit board (PCB) carried by the portable housing, a ground plane and a wireless transceiver carried by the PCB, an antenna connected to the wireless transceiver and carried by the PCB, the method comprising:

positioning at least one director element for directing a beam pattern of the antenna to reduce interference with the electronic hearing aid, the at least one director element comprising an electrically conductive main branch carried by the portable housing and an electrically conductive connector portion extending transversely from the electrically conductive main branch to the PCB.

23. The method of claim 22 wherein the PCB has a generally rectangular shape with opposing sides and opposing ends; and wherein the electrically conductive main branch extends parallel with a side of the PCB.

24. The method of claim 22 wherein the PCB comprises a top portion and a bottom portion; and wherein the antenna is carried by the bottom portion of the PCB.

25. The method of claim 22 wherein the antenna has an operating wavelength; and wherein the electrically conductive main branch has a length of about ¼ to ½ the operating wavelength.

* * * * *